US005268572A

United States Patent [19]

Mordehai et al.

[11] Patent Number: 5,268,572

[45] Date of Patent: Dec. 7, 1993

[54] DIFFERENTIALLY PUMPED ION TRAP MASS SPECTROMETER

[75] Inventors: Alex Mordehai, Ithaca; John D. Henion, Trumansburg, both of N.Y.

[73] Assignee: Cornell Research Foundation, Inc., Ithaca, N.Y.

[21] Appl. No.: 948,394

[22] Filed: Sep. 23, 1992

[51] Int. Cl.[5] ..... H01J 49/24; H01J 49/42

[52] U.S. Cl. ..... 250/289; 250/292; 250/291; 250/290

[58] Field of Search ..... 250/289, 290, 291, 292

[56] References Cited

U.S. PATENT DOCUMENTS

| | | | |
|---|---|---|---|
| 4,542,293 | 9/1985 | Fenn et al. | 250/288 |
| 4,810,878 | 3/1989 | Kobayashi | 250/288 |
| 4,849,628 | 7/1989 | McLuckey et al. | 250/282 |
| 4,851,700 | 7/1989 | Goodley | 250/288 |
| 4,889,987 | 12/1989 | Gruen et al. | 250/282 |
| 4,933,551 | 6/1990 | Bernius et al. | 250/288 |
| 4,935,624 | 6/1990 | Henion et al. | 250/288 |
| 4,963,735 | 10/1990 | Okamoto et al. | 250/288 |

OTHER PUBLICATIONS

"Electrospray Ionization Combined with Ion Trap Mass Spectrometry" Analytical Chemistry, vol. 62, No. 13, Jul. 1, 1990 pp. 1284–1295 Berkel et al.

"Ion Spray Liquid Chromatography/Ion Trap Mass Spectrometry Determination of Biomolecules" McLuckey et al., Analytical Chemistry, vol. 63, No. 4, Feb. 15, 1991, pp. 375–383.

*Primary Examiner*—Jack I. Berman

*Attorney, Agent, or Firm*—Jones, Tullar & Cooper

[57] ABSTRACT

An ion trap mass spectrometer includes an ion trap region separated from an electron multiplier region by a baffle, and separate turbomolecular pumps for pumping each region to a different pressure level. The ion trap region can therefore be pumped to a higher pressure level than ca be used for the electron multiplier region, and the result and increase in pressure of damping gas in the ion trap region increases the sensitivity of the device.

14 Claims, 3 Drawing Sheets

DIFFERENTIALLY PUMPED ION TRAP MASS SPECTROMETER

BACKGROUND OF THE INVENTION

The present invention relates in general to an ion trap mass spectrometer having two separate vacuum regions allowing for use with various ionization techniques for ion production outside the spectrometer's ion trap mass analyzer. In particular, this invention relates to atmospheric pressure ionization (API) techniques (electrospray, ion spray, corona discharge etc.) for use with the ion trap mass spectrometer for direct composition analysis of liquids.

An ion spray interface for an ion trap mass spectrometer is the subject of copending application, USSN 07/889,693, filed May 29, 1992, which is hereby incorporated by reference. The interface disclosed therein permits the injection and mass analysis of ions formed at atmospheric pressure into a quadrupole ion trap mass spectrometer. With the interface, ions formed from a spray of charged solvent droplets can be injected into the ion trap mass analyzer, thereby permitting the use of condensed-phase separation science technologies, such as liquid chromatography/mass spectrometry (LC/MS), capillary electrophoresis/mass spectrometry (CE/MS) and ion chromatography/mass spectrometry (IC/MS).

One difficulty encountered when using the device set forth in USSN 889,693 for API/MS applications is that of effective ion injection and confinement in the ion trap mass analyzer.

SUMMARY OF THE INVENTION

The present invention provides an ion trap mass spectrometer structure which enables more ions to be injected and confined within the ion trap, thereby increasing sensitivity. To do this, the number of damping gas (e.g. He) molecules present in the ion trap is increased by increasing pressure in the ion trap region. As a result, the externally produced ions collide with the helium molecules and lose energy, thereby enabling them to be more easily captured in the ion trap. Unfortunately, the necessary increase in ion trap pressure to achieve this result is not compatible with the spectrometer's electron multiplier that is commonly used to detect the ions. To overcome this problem, the present invention employs a baffle to separate the ion trap region from the electron multiplier region, and separate turbomolecular pumps are employed to provide differential pumping of the two regions.

In the preferred embodiment of the invention, the interface disclosed in USSN 889,693 is coupled to an entrance end cap of the ion trap system so that externally produced ions at atmospheric pressure may be introduced into the ion trap. The differential pumping of the mass-analyzed ion trap region and the detection region permits a much higher helium pressure in the ion trap region, thereby improving sensitivity of the instrument.

BRIEF DESCRIPTION OF THE DRAWING

The features and advantages of the present invention will become apparent to those of skill in the art from the following detailed description of a preferred embodiment thereof, taken in conjunction with the accompanying drawing, in which.

DETAILED DESCRIPTION OF THE PREFERRED EMBODIMENTS

Figure 1:
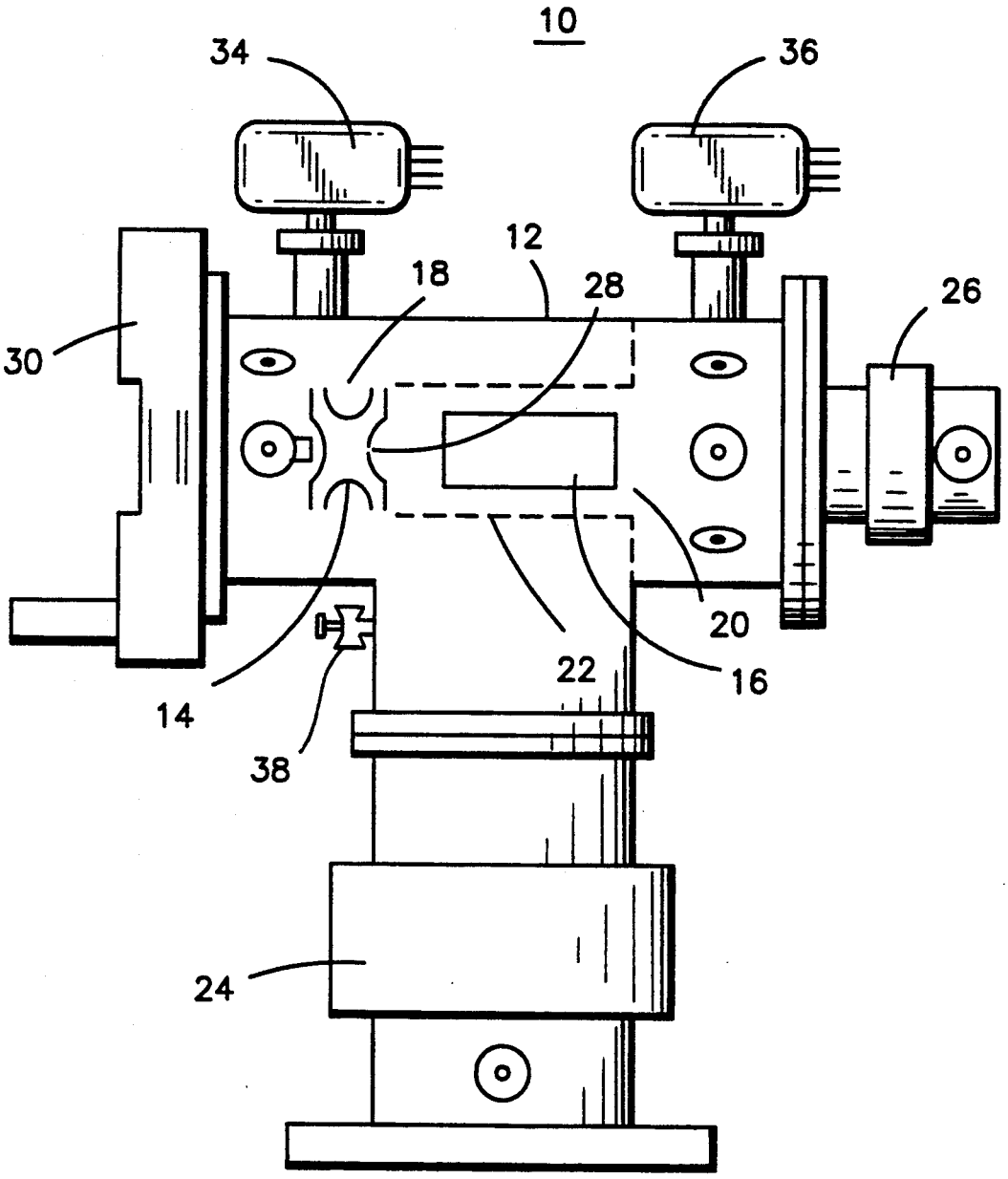
FIG. 1 is a diagrammatic illustration of an ion trap mass spectrometer that forms the preferred embodiment of the present invention.

Turning now to a more detailed consideration of a preferred embodiment of the present invention, FIG. 1 illustrates an ion trap mass spectrometer structure 10 including a housing 12 containing a hyperbolic ion trap analyzer 14 and an electron multiplier detector 16.

The hyperbolic ion trap analyzer 14 is contained within an ion trap region 18 of the housing 12, while the electron multiplier detector 16 is contained within an electron multiplier region 20 of the housing 12. The two regions 18 and 20 are separated from one another by means of a baffle 22.

A first turbomolecular pump 24 is placed in communication with the ion trap region 18 for pumping this region to a first desired pressure level, while a second turbomolecular pump 26 is placed in communication with the electron multiplier region 20 for pumping this region to a second desired pressure level. The only communication between the ion trap 14 and the electron multiplier 16 is by way of a pinhole 28 approximately 1 mm in diameter disposed in the ion trap 14 which permits ions to enter the electron multiplier region 20 for detection.

An atmospheric pressure interface 30 constructed in accordance with the device set forth in USSN 889,693 is coupled to the ion trap analyzer 14 for introducing externally produced ions at atmospheric pressure into the ion trap analyzer 14. First and second ion gauge manometers 34 and 36 are attached to the housing 12 in communication with the ion trap region 18 and electron multiplier region 20, respectively, for measuring the respective pressures therein. An adjustable variable leak valve 38 is mounted on the housing 12 for introducing damping gas, such as helium, into the ion trap region 18.

Preferably, the first turbomolecular pump 24 is capable of pumping 500 liters per second so that the ion trap region 18 can be pumped to a base pressure of approximately $5\times10^{-5}$ Torr. When damping gas such as helium, is introduced into the ion trap region 18 through the variable leak valve 38, the total pressure in the ion trap region 18 is preferably between $5\times10^{-3}$ and $8\times10^{-3}$ Torr. The second turbomoleoular pump 26 is selected to pump 60 liters per second so that the electron multiplier region 20 can be pumped to a lower pressure of at least approximately $2\times10^{-5}$ Torr. The pressure ratio between the ion trap region 18 and the electron multiplier region 20 is therefore greater than 100:1.

Figure 2:
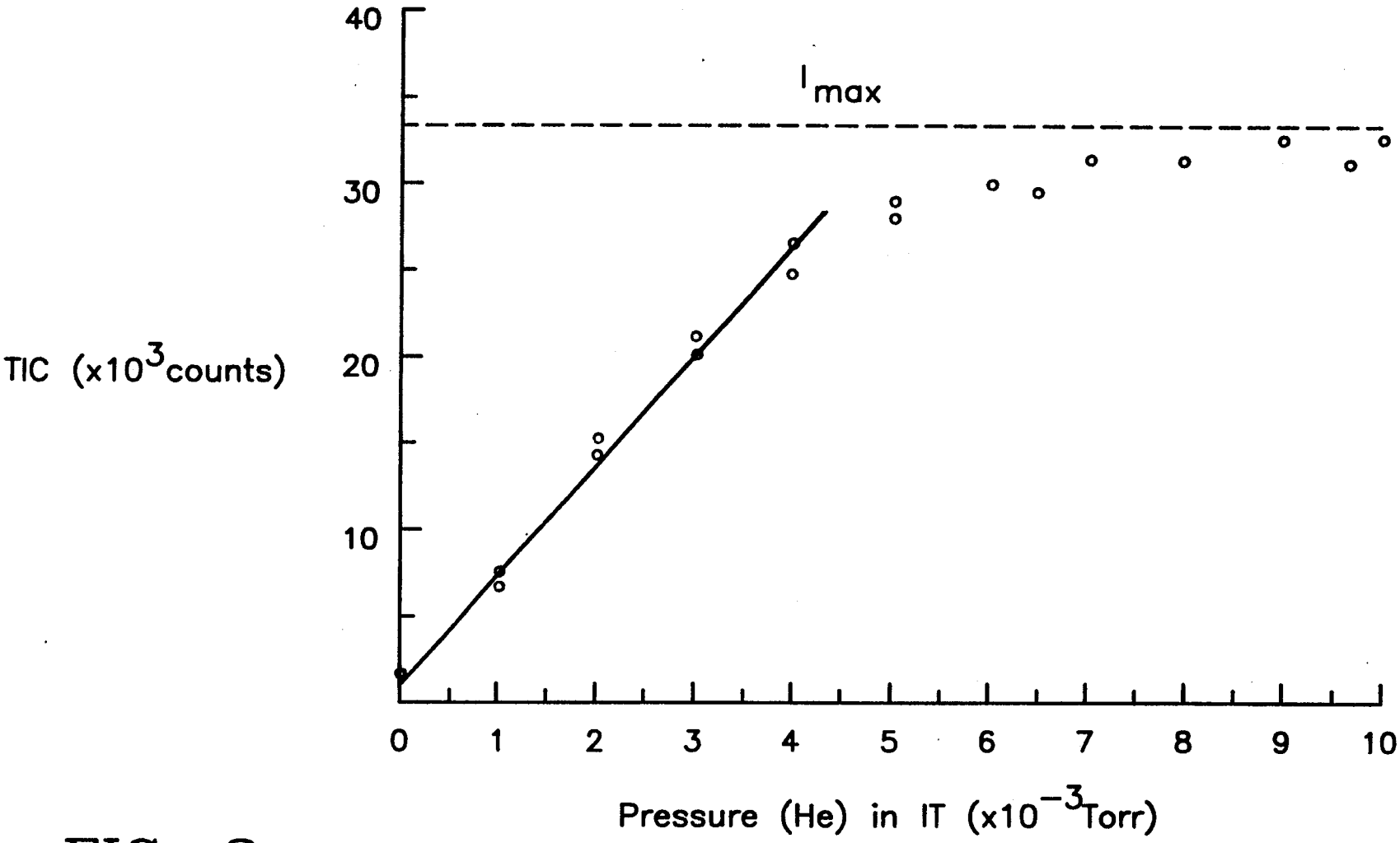
FIG. 2 illustrates the relationship between total ion current (TIC) and pressure of helium damping gas in the ion trap region of the mass spectrometer; and, FIGS. 3A and 3B illustrate the mass spectrum of TBAH with helium damping gas pressure of $6\times10^{-3}$ Torr in the ion trap region.

To test the sensitivity and mass resolution of an ion trap mass spectrometer constructed in accordance with the present invention, simple infusion experiments were conducted. Tetrabutylammonium hydroxide (TBAH), a tetraalkyl quaternary amine that exists in aqueous solution as a cation was chosen for these studies. Experimental conditions leading to confinement of externally produced ions in the ion trap were also studied FIG. 2 shows the dependence of total ion current (TIC) vs.

pressure of the helium damping gas in the ion trap. The ability of the hyperbolic ion trap to capture externally produced ions was increased linearly with pressure up to the pressure of $5\times10-3$ Torr, and was saturated at a defined value in the pressure range $5\times10^{-3}$ to $1\times10^{-2}$ Torr. From this relationship, it is apparent that the maximum trapping efficiency and sensitivity correspond to a helium pressure between $5\times10^{-3}$ and $1\times10^{-2}$ Torr. It should be noted that normal operating conditions for an ion trap mass spectrometer without a differential pumping system require the pressure of helium to be below $1\times10^{-3}$ Torr. Thus, the present invention is at least five times more sensitive than would be a device having a single pressure region. The differential pumping of the ion trap region 18 and the electron multiplier region 20 therefore allows much higher helium pressure in the ion trap region 18, thus improving sensitivity substantially.

Figures 3A, 3B:
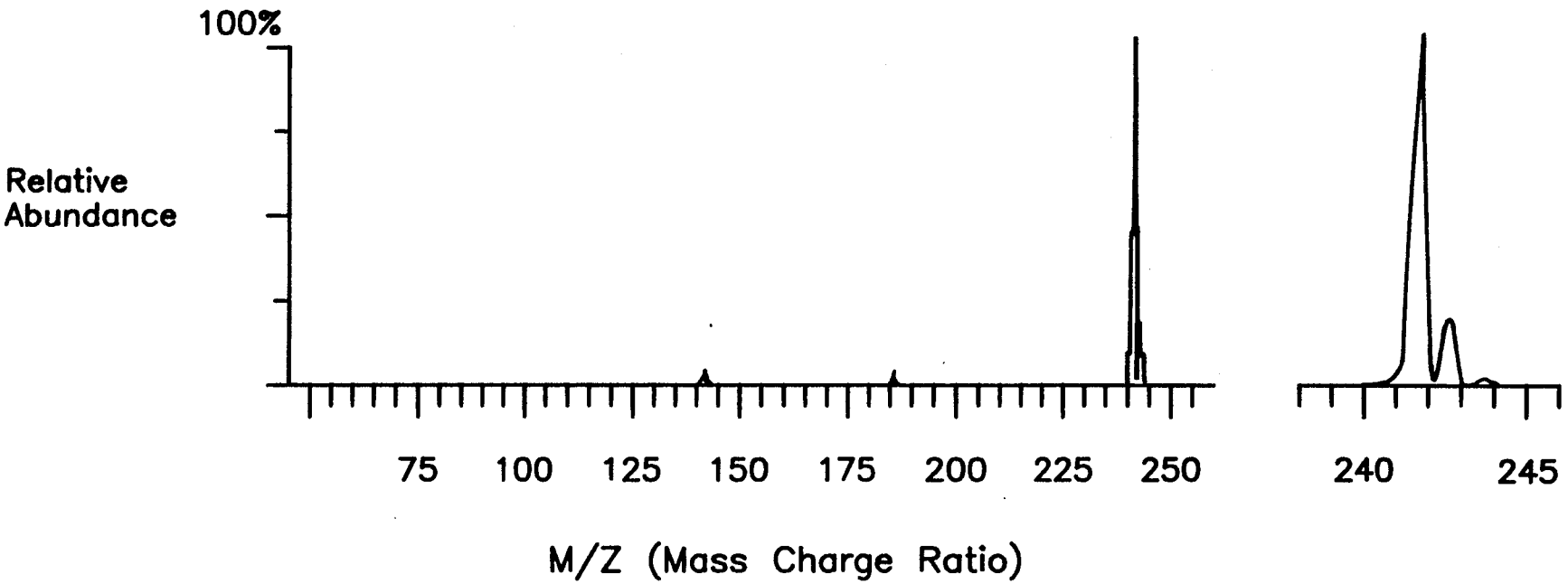

A typical mass spectrum from 1 pmol/μL TBAH in methanol, obtained under mild declustering conditions is shown in FIGS. 3A and 3B. In particular, FIG. 3A shows that the base peak in the mass spectrum corresponds to the molecular ion of TBAH ($m/z=242$). Unit mass resolution of the $^{12}C$ and $^{13}C$ isotopes of TBAH (molecular ion) was observed and is illustrated in the enlargement of FIG. 3B. FIGS. 3A and 3B show that the present invention provides a much cleaner (through reduced noise) mass spectrum than can be obtained with previous mass spectrometers.

Although the invention has been disclosed in terms of a preferred embodiment, it will be understood that numerous variations and modifications could be made thereto without departing from the scope of the invention as defined in the following claims.

What is claimed is:

1. A differentially pumped ion trap mass spectrometer comprising:

a housing including a first enclosed region and a second enclosed region;

a baffle separating said first and second enclosed regions;

an ion trap disposed in said first region;

an electron multiplier detector disposed in said second region;

first pump means in communication with said first region for pressurizing said first region to a first pressure level;

second pump means in communication with said second region for pressurizing said second region to a second pressure level different from that of said first pressure level; and, means to inject ions into said ion trap for subsequent detection by said electron multiplier detector.

2. The spectrometer of claim 1, wherein said first pump means pumps said first region to a pressure level of approximately $6\times10^{-3}$ Torr, and said second pump means pumps said second pump region to a pressure level of approximately $2\times10^{-5}$ Torr.

3. The spectrometer of claim 1, further including a pinhole disposed between said first and second regions for admitting ions from said ion trap to said electron multiplier detector.

4. The spectrometer of claim 1, further including valve means for introduction of damping gas into said first region.

5. The spectrometer of claim 4, wherein said valve means is adjustable for varying the damping gas pressure in said first region.

6. The spectrometer of claim 4, further including first pressure measuring means in communication with said first region for measuring pressure of damping gas therein and second pressure measuring means in communication with said second region for measuring the pressure in said second region.

7. A differentially pumped ion trap mass spectrometer comprising:

a housing including a first enclosed region and a second enclosed region;

means separating said first and second enclosed regions;

an ion trap disposed in said first region;

an electron multiplier detector disposed in said second region for detecting ions from said ion trap; and, means for pressurizing said first region to a first pressure level and said second region to a second pressure level different from that of said first pressure level.

8. The spectrometer of claim 7, wherein said means for pressurizing comprises first pump means in communication with said first region and second pump means in communication with said second region.

9. The spectrometer of claim 8, wherein said first pump means pumps said first region to a pressure level of approximately $6\times10^{-3}$ Torr, and said second pump means pumps said second pump region to a pressure level of approximately $2\times10^{-5}$ Torr.

10. The spectrometer of claim 7, wherein said means separating said first and second enclosed regions comprises a baffle.

11. The spectrometer of claim 7, further including a pinhole disposed between said first and second regions for admitting ions from said ion trap to said electron multiplier detector.

12. The spectrometer of claim 7, further including valve means for introduction of damping gas into said first region.

13. The spectrometer of claim 12, wherein said value means is adjustable for varying the damping gas pressure in said first region.

14. The spectrometer of claim 12, further including first pressure measuring means in communication with said first region for measuring pressure of damping gas therein and second pressure measuring means in communication with said second region for measuring the pressure ins aid second region.

* * * * *